US007056399B2

(12) United States Patent
Cai et al.

(10) Patent No.: US 7,056,399 B2
(45) Date of Patent: Jun. 6, 2006

(54) PASSIVATION OF STEEL SURFACE TO REDUCE COKE FORMATION

(75) Inventors: Haiyong Cai, Calgary (CA); Michael C. Oballa, Cochrane (CA); Andrzej Krzywicki, Calgary (CA); Leslie Wilfred Benum, Red Deer (CA)

(73) Assignee: NOVA Chemicals (International) S.A., Fribourg (CH)

( * ) Notice: Subject to any disclaimer, the term of this patent is extended or adjusted under 35 U.S.C. 154(b) by 332 days.

(21) Appl. No.: 10/425,544

(22) Filed: Apr. 29, 2003

(65) Prior Publication Data

US 2004/0216815 A1 Nov. 4, 2004

(51) Int. Cl.
*C21D 1/74* (2006.01)

(52) U.S. Cl. ..... 148/634; 148/633

(58) Field of Classification Search ..... 148/633, 148/634
See application file for complete search history.

(56) References Cited

U.S. PATENT DOCUMENTS

| | | | |
|---|---|---|---|
| 4,636,297 | A | 1/1987 | Uchiyama et al. |
| 4,687,567 | A | 8/1987 | Porter et al. |
| 4,692,234 | A | 9/1987 | Porter et al. |
| 4,804,487 | A | 2/1989 | Reed et al. |
| 5,354,450 | A | 10/1994 | Tong et al. |
| 5,358,626 | A | 10/1994 | Gandman et al. |
| 5,360,531 | A | 11/1994 | Tong et al. |
| 5,501,878 | A | 3/1996 | Barendregt et al. |
| 5,630,887 | A | 5/1997 | Benum et al. |
| 5,777,188 | A | 7/1998 | Reed et al. |
| 5,779,881 | A | 7/1998 | Tong et al. |
| 5,954,943 | A | 9/1999 | Tong et al. |
| 6,436,202 | B1 | 8/2002 | Benum et al. |
| 2002/0029514 | A1 | 3/2002 | Lindstrom |

*Primary Examiner*—Deborah Yee
(74) *Attorney, Agent, or Firm*—Suzanne Kikel

(57) ABSTRACT

The present invention provides a process to treat steels, preferably carbon steel to reduce the tendency of the steel to form coke when in contact with hydrocarbons at elevated temperatures. The steel may be first reduced then treated with a mixture of compounds which further modify the reduced surface and finally the treated steel surface is cured. The treated steel has a reduced propensity to form coke when in contact with hydrocarbons particularly at higher temperatures.

12 Claims, 2 Drawing Sheets

Schematic of TGTU

Figure 1. Schematic of TGTU
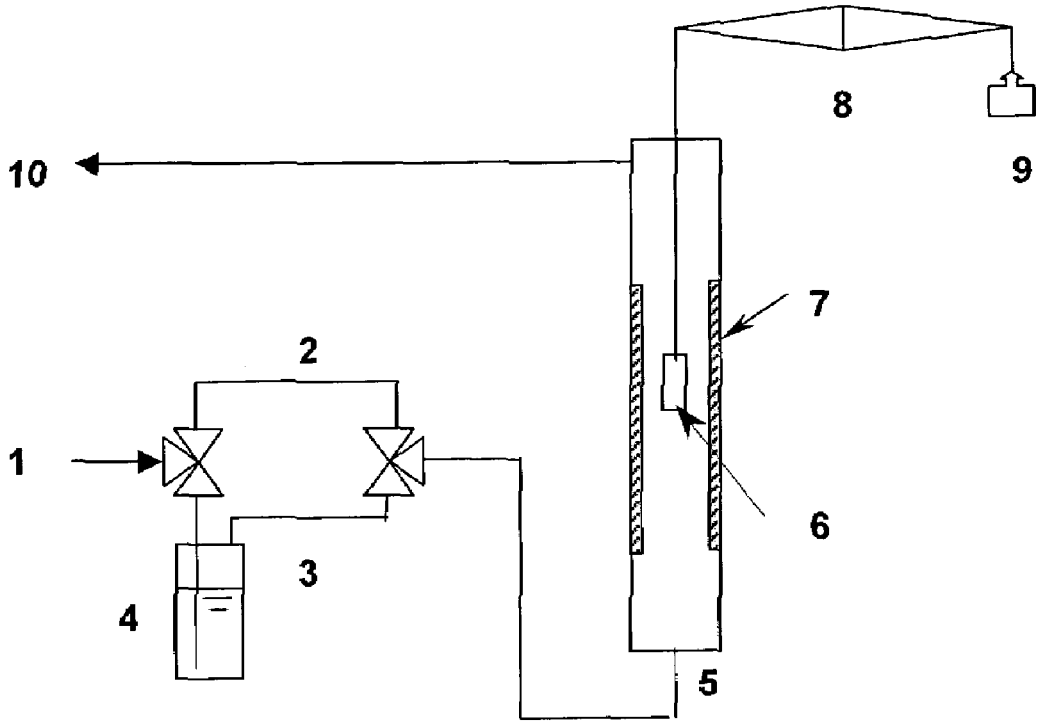

Figure 2. Schematic of TCQR
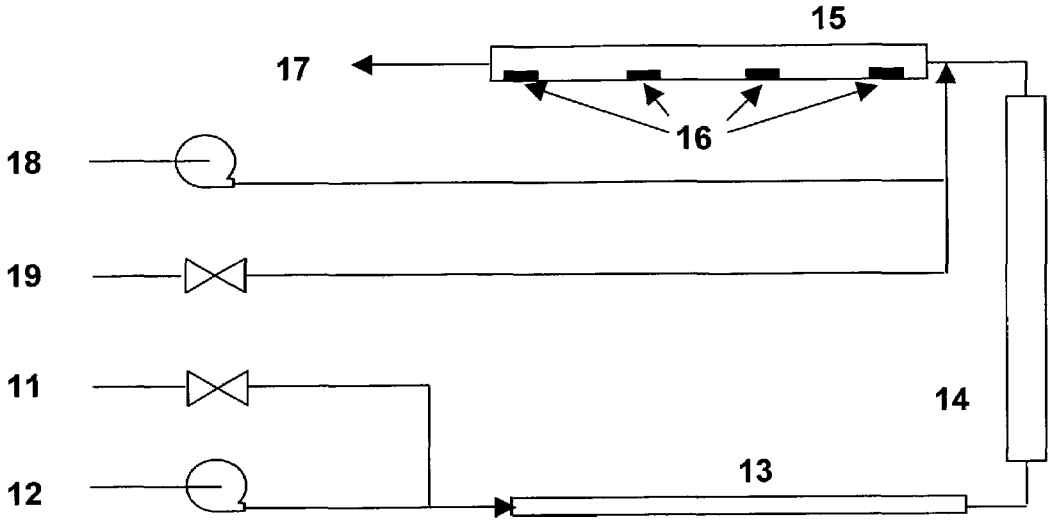

PASSIVATION OF STEEL SURFACE TO REDUCE COKE FORMATION

FIELD OF THE INVENTION

The present invention relates to a process for treating steels to make them more resistant to coke formation in hydrocarbon processes. Specifically, the method involves a surface treatment process for steels used in transfer line exchangers of steam crackers for ethylene production and in reactors and heat exchangers of refinery processes. Typically, such equipment in contact with hydrocarbon streams are operated at temperatures ranging from 200° C. to 900° C.

BACKGROUND OF THE INVENTION

In the refinery and petrochemical industry, the most commonly used materials for reactors and heat exchangers are carbon steels due to cost consideration. Often, high alloy steels are used only for hydrocarbon processes where other requirements such as corrosion or operating temperature may become an issue. It is well-known that iron and its oxides present on steel surfaces could act as promoters for coke formation.

Coke formation on equipment surfaces could cause many problems for process operation. Among them, two often mentioned problems are the reduced (distorted) heat transfer across the equipment walls due to the build-up of coke deposits having poor thermal conductivity, and increased pressure drop due to the accumulated coke deposit which can substantially reduce the opening for the process stream and which also increases the surface roughness in contact with hydrocarbon stream. Both of these effects can affect the designed performance of a particular equipment. Other problems with coke formation in hydrocarbon processing equipment include loss of operation time and the required maintenance cost for coke removal using on-line or off-line methods. For example, in transfer line exchangers used for quenching the effluent stream from a steam cracker, coke formation often becomes a major problem restricting furnace run length, especially for naphtha cracking. With emerging technologies for longer furnace run length, coke formation in the transfer line exchangers must be dealt with.

There have been a number of proposals for treatment of steels to reduce their tendency to coke when exposed to hydrocarbons at elevated temperatures. In general, these proposals in the prior art could fall into two categories—the use of coke inhibiting compounds or mixtures to react with the steel surface and form an inert surface prior to its exposure to process hydrocarbons and/or during hydrocarbon processing, and surface passivation through treatment using gases such as hydrogen, carbon dioxides, air or steam prior to exposure to hydrocarbons.

Injection of coke inhibiting compounds or mixtures has become a very popular approach for technology development and to some extent for plant practice.

U.S. Patent Application 20020029514 published Mar. 14, 2002 assigned to Atofina Chemicals Inc. teaches treating a furnace, preferably co-injecting with steam and one or more compounds of the formula R—$S_x$—R' where x is an integer from 1 to 5 and R and R' are selected from the group consisting of a hydrogen atom and a $C_{1-24}$ straight chain or branched aryl radicals, and one or more compounds of the formula:

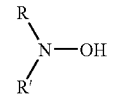

(hydroxylamine)

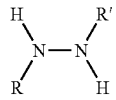

(hydrazine)

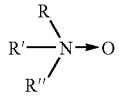

(amine oxides)

wherein R, R' and R" are selected from the group consisting of $C_{1-24}$ straight or branched aryl radicals. The present invention has not only eliminated the hydroxylamines, hydrazines and amine oxides required by the prior art, but also identified additional but essential steps to make the passivation of steel surface more stable.

U.S. Pat. No. 4,636,297 issued Jan. 13, 1987 to Uchiyama et al., assigned to Hakuto Chemical Co., Ltd. teaches applying a mixture of dialkyl thioureas and thiuram mono- and/or di-sulfides in an amount from 10 to 5,000 ppm to the surface of a reactor prone to coke formation. The reference does not teach the specific components used in the present invention nor does it disclose the preliminary reduction nor the curing steps required in the present invention.

U.S. Pat. No. 5,777,188 issued Jul. 7, 1998 to Reed et al., assigned to Phillips Petroleum Company discloses adding to the feed of a steam cracker with steam as a carrier gas and a mixture of polysufides of the formula R—Sx—R' wherein R and R' are independent hydrocarbyl radical having 1 to about 30 carbon atoms and x is a number from about 3 to 10. The proposed weight ratio of polysulfides to steam is in the range from about 0.00002:1 to about 1:1. Again the reference fails to teach the specific components used in the present invention nor does it disclose the preliminary reduction and the curing steps required in the present invention.

In addition, there are many other chemicals or mixtures of them that could be used for reduction of coke formation under cracking and TLE operating conditions. Tong et al. has claimed a number of organic phosphorous compounds (U.S. Pat. Nos. 5,354,450; 5,779,881; 5,360,531 and 5,954,943, assigned to Nalco/Exxon) that can be used as coke inhibitors for coke reduction under coil and TLE conditions. A combination of gallium, tin, silicon, antimony, and aluminum has also been claimed in the prior art (U.S. Pat. Nos. 4,687,567; U.S. 4,692,234; and U.S. 4,804,487), assigned to Phillips Petroleum. Additionally, certain inorganic salts, a mixture of Group IA and IIA metal salts and a boron acid (U.S. Pat. No. 5,358,626) assigned to Tetra International, have been claimed as effective in coke reduction under coil conditions. Once again, these references fail to teach the specific components used in the present invention nor do they disclose the preliminary reduction nor the curing steps required in the present invention.

The other group of methods or processes available in the prior art, teaches the use of gases, such as $H_2$, carbon oxides, steam and air to treat steel surfaces prior to their exposure to hydrocarbon process streams in order to minimize the coking propensity of steel surfaces.

U.S. Pat. No. 5,501,878 issued Mar. 26, 1996, assigned to Mannesmann Aktiengesellschaft; KTI Group B.V. teaches treating the surface of a heat exchanger which comes in contact with hydrocarbons with a mixture of steam and 5 to 20 weight % hydrogen at a temperature from about 400° C. to 550° C. for from 1 to 6 hours to reduce $Fe_2O_3$, that is catalytically active to produce coke, to $Fe_3O_4$ that is not as active to produce coke. The present invention uses a lower amount of hydrogen than that specified in the reference and comprises further steps not disclosed in the reference.

U.S. Pat. No. 6,436,202 issued Aug. 20, 2002, assigned to NOVA Chemicals teaches a process for treating stainless steel comprising from 13–50 weight % Cr, 20–50 weight % Ni and at least 0.2 weight % Mn in the presence of a low oxidizing atmosphere, which comprises from 0.5 to 1.5 weight % of steam, from 10 to 99.5 weight % of one or more gases selected from the group consisting of hydrogen, CO and CO2 and from 0 to 88 weight % of an inert gas selected from the group consisting nitrogen, argon and helium. In an earlier U.S. Pat. No. 5,630,887, again assigned to NOVA Chemicals (previously NOVACOR Chemicals) a similar procedure was proposed for the treatment of stainless steel furnace tubes which are used in the petrochemical industry. This treatment involves exposing stainless steel to an atmosphere containing a low amount of oxygen at temperatures up to 1200° C. for up to about 50 hours. The stainless steel treated according to such a procedure will have a lower tendency to coke formation during use. However, these treatments are not suggested for steels with a Cr content less than 13 weight %, for instance, carbon steel, which comprises typically less than 5 weight % Cr. In addition, the required use of the coke inhibiting compounds of the present invention and the curing step have not been disclosed in these references.

The present invention seeks to provide an effective method of treating a steel, preferably but not limited to carbon steels, subject to conditions where coke is likely to form to reduce coke formation.

SUMMARY OF THE INVENTION

The present invention provides a process for treating a steel comprising not less than 35 weight % Fe, comprising:

(i) reducing the surface of the steel by contacting it with a mixture comprising from 0.001 to 4.9 weight % of $H_2$ and 99.999 to 95.1 weight % of one or more gases selected from the group consisting of inert gases (such as argon, nitrogen, helium, etc.) and steam at a temperature of from 200° C. to 900° C. and a pressure from 0.1 to 500 psig for a time from 10 minutes to 10 hours;

(ii) treating the reduced surface of the steel with a composition comprising:

(a) from 5 to 80 weight % of dimethyl disulfide;

(b) from 10 to 70 weight % tetra-butyl poly sulfide;

(c) from 2 to 15 weight % pentaerythritol tetrakis (3-mercaptopropionate);

(d) optionally from 0 to 10 weight % ethyl 2-mercaptopriopionate;

(e) from 0.1 to 10 weight %, dimethyl methylphosphonate; and (f) from 0.2 to 5 weight % disulfiram, the sum of components (a) through (f) being adjusted to a total 100 weight %, in an amount from 10 to 10,000 ppm in a carrier gas selected from the group consisting of steam, inert gases and hydrocarbons at a temperature from 400° C. to 850° C. for a time from 10 minutes to 10 hours; and (iii) curing the resulted surface in a carrier gas selected from the group consisting of steam, and inert gases (such as argon, nitrogen and helium) or a mixture thereof for a time from 0.1 to 50 hours.

BRIEF DESCRIPTION OF THE DRAWINGS

FIG. 1 is a schematic drawing of the thermogravimetric testing unit (TGTU) used in the examples.

FIG. 2 is a schematic drawing of the tubular cracking and quenching reactor (TCQR) used in the examples.

DETAILED DESCRIPTION

The present invention relates to the treatment of steels, particularly but not limited to carbon steels, including steels with a Fe composition of at least 35 weight % (wt %) (i.e. from 35 to 100 wt % Fe), preferably 60 to 100 wt %, most preferably 80 to 100 wt % Fe. This will include HK, HP steel alloys, but not higher grade steel alloys. The classification and composition of such steels are known to those skilled in the art.

One type of stainless steels which may be used in accordance with the present invention broadly comprises: from 10 to 45, preferably from 12 to 35 weight % of chromium and at least 0.2 weight %, up to 3 weight % preferably not more than 2 weight % of Mn; from 20 to 50, preferably from 25 to 48, weight % of Ni; from 0.3 to 2, preferably 0.5 to 1.5 weight % of Si; less than 5, typically less than 3 weight % of titanium, niobium and all other trace metals; and carbon in an amount of less than 0.75 weight %. The balance of the stainless steel is substantially iron.

A complete treatment procedure consists of a preliminary reduction step of the steel surface, a passivation step involving the use of coke inhibiting compounds and their mixtures, and a curing period using steam and one or more of inert gases to stabilize the already passive steel surfaces. This treatment procedure may be carried out on the steel in situ (e.g. in a cracker or a reactor for a hydrocarbon process) as well as externally such as an off-site treatment.

In the first step of the present invention the steel is reduced typically using $H_2$ mixed with one or more gases selected from the group consisting of inert gases such as argon, nitrogen, helium etc., and steam and mixtures thereof. Preferably the gas is steam. Generally, the steel surface is treated with hydrogen in steam alone or optionally together with some of the inert carrier gas such as argon, nitrogen, helium etc. The hydrogen may be present in the carrier gas in an amount from 0.001 to 4.9, preferably 0.01 to 2, most preferably 0.1 to 1 weight %.

The treatment is carried out at temperatures from 200° C. to 900° C. preferably 300° C. to 800° C., most preferably from 300° C. to 700° C.; and at pressures from 0.1 (0.689 kPa gage) to 500 psig ($3.447\times10^3$ kPa gage), preferably from 0.1 to 300 psig ($2.068\times10^3$ kPa gage), most preferably from 0.1 to 100 psig ($6.89\times10^2$ kPa gage) for a time from 10 minutes to 10 hours, preferably from 30 minutes to 5 hours, most preferably from 1 to 3 hours.

During the second step of the present treatment procedure, several coke inhibiting compounds and mixtures thereof may be used to passivate the steel surface so that the treated steel has less of a tendency for coke formation. The composition of the coke inhibiting compounds used comprises:

(a) from 5 to 80, preferably 25 to 50 wt % of dimethyl disulfide;
(b) from 10 to 70, preferably 20 to 40 wt % tetra-butyl polysulfide;
(c) from 2 to 15, preferably 5 to 10 wt % pentaerythritol tetrakis (3-mercaptopropionate);
(d) optionally from 0 to 10, preferably from 3 to 8 wt % ethyl 2-mercaptopriopionate;
(e) from 0.1 to 10, preferably from 1 to 5 wt %, dimethyl methylphosphonate; and
(f) from 0.2 to 5, preferably from 0.5 to 1.5 wt % disulfiram, the sum of components (a) through (f) being adjusted to total 100 wt %.

These coke inhibiting compounds or mixture may be carried onto steel surface by a carrier medium selected from the group consisting of inert gases such as argon or nitrogen, or steam, or light hydrocarbons such as methane or ethane, or a mixture thereof, in an amount from 10 to 10,000 ppm (weight), at a temperature from 300° C. to 850° C. for a time from 10 minutes to 10 hours, preferably in an amount from 20 to 5,000 ppm (by weight), most preferably in an amount from 30 to 2,000 ppm (by weight (e.g. wppm) preferably at a temperature from 300 to 800° C. for 30 minutes to 5 hours.

In accordance with the present invention, the resulting steel surface should be further treated by following a curing procedure, which may consist of passing steam alone or steam mixed with one or more inert gases such as argon or nitrogen at a steam concentration no less than 2 wt %. This curing process may be carried out at a temperature between 200° C. and 900° C., preferably 300° C. to 800° C. for a period of 0.1 to 50 hours, preferably 0.5 to 20 hours at steam partial pressures from 0.1 (0.689 kPa gage) to 100 psig (68.95 kPa gage), preferably from 0.1 to 60 psig (413.7 kPa gage), most preferably from 0.1 to 30 psig (206.8 kPa gage).

The steels treated in accordance with the present invention may be used in processing a number of types of hydrocarbons including lower $C_{1-8}$ alkanes such as ethane, propane, butane, naphtha, vacuum gas oil, atmospheric gas oil, and crude oil. Preferably, the hydrocarbons will comprise a significant amount (e.g. greater than 60 wt %) of $C_{1-8}$ alkanes, most preferably selected from the group consisting of ethane, propane, butane and naphtha.

The steel treated in accordance with the present invention may be used in a number of applications where a hydrocarbon will be exposed to the steel at relatively mild temperatures typically at temperatures from 300° C. to 800° C. One use for the steels treated in accordance with the present invention is in the transfer line exchanger (TLE) at the outlet of a coil of a steam cracking furnace.

The present invention will now be illustrated by the following non-limiting examples. In the examples either or both of a thermogravimetric testing unit (TGTU) used in the examples and a tubular cracking and quenching reactor (TCQR) may be used.

The thermogravimetric testing unit (TGTU) is illustrated in FIG. 1. In the TGTU a controlled flow of one of the feed gases ($C_2H_6$, $N_2$, $H_2$ or Air) is introduced into the unit through inlet 1 prior to entering the TGTU furnace tube 5 either through a dry route 2 or through a wet route 3. The wet route 3 consists of a water vapor saturator 4 which is maintained at about 60° C. The TGA is a commercial instrument from Setaram, France, which has the capability to heat samples up to 1200° C. under various gases. The TGA furnace 5 is made of a 20 mm internal diameter alumina tube in the middle section 7 (homogenous temperature zone), while the housing is made of a heat resistance alloy which provides water cooling for temperature control. A sample of interest can be either placed in a quartz crucible 6 or simply as a metal coupon by itself 6, which was attached to one side of balance arms 8. The sample weight could be from 2 mg to 20 grams, counter balanced by a custom weight 9. During each test, a feed gas saturated with water vapor at 60° C. (or without through the dry inlet 2) passes through the cracking zone 7 and the cracked (or inert) gas is cooled in the upper section of the furnace tube before entering the vent line 10. The temperature profile of this upper furnace section was known based on calibrations under TGA operating conditions of interest. Therefore, it was also feasible to place a sample or a metal coupon at positions of various temperatures applicable to TLE operation.

The schematic of TCQR is shown in FIG. 2 where hydrocarbon feeds are introduced into the reactor through a flow control system 11. A metering pump 12 delivers the required water for steam generation in a preheater 13 operating at 250° C. to 300° C. The vaporized hydrocarbon stream then enters a tubular quartz reactor tube 14 heated to either 900° C. for ethane cracking or 850° C. for naphtha cracking, where steam cracking of the hydrocarbon stream takes place to make pyrolysis products. The product stream then enters the quartz tube 15 which simulates the operation of a transfer line exchanger or quench cooler of industrial steam crackers. This transfer line exchanger was designed and calibrated in such a way that metal coupons 16 can be placed at exact locations where temperatures are known. Typically, such metal coupons are located at the positions where the temperature is 650° C., 550° C., 450° C. and 350° C. Coupons are weighed before and after an experiment to determine the weight changes and the coupon surfaces can be examined by various instruments for morphology and surface composition. After the transfer line exchanger 15, the process stream 17 enters a product knockout vessel where gas and liquid effluents can be collected for further analyses or venting. In the reactor unit, another metering pump 18 is used to deliver a coke inhibitor at precise flow rates and a gas control system 19 to atomize the coke inhibitor solution in such a way that an optimal atomization was achieved at the inlet of the transfer line exchanger 15.

EXAMPLE 1

A series of sample powders of Fe containing compounds (listed in Table 1) were tested under simulated ethane cracking conditions at 840° C. in the TGTU. Initially, the TGTU furnace was heated at a rate of 15° C./min in a flow of $N_2$ purge at 25 sccm (standard cubic centimeters per second). When the temperature reached 840° C., ethane was admitted via the wet route at 15 sccm and cracked in the cracking zone (7 of FIG. 1). The coke formation rate of a powder sample (typically weighing about 20 mg, and having a particle size of about 200 μm), placed at the 600° C. position in the upper section of the TGTU furnace tube, was then monitored for a period of 60 minutes. The results for the selected Fe compounds are shown in Table 1.

TABLE 1

| Sample | Coking Rate (mg/mgFe-hr) | | |
|---|---|---|---|
| Powder | Averaged | Maximum | Note |
| $Fe_2O_3$ | 10.9 | 24.1 | Slight decomposition in cracked gas |
| $Fe_3O_4$ | 3.5 | 8.5 | Slight decomposition in cracked gas |

TABLE 1-continued

| Sample | Coking Rate (mg/mgFe-hr) | | |
|---|---|---|---|
| Powder | Averaged | Maximum | Note |
| $FeSO_4$—$7H_2O$ | 2.8 | 7.8 | Decomposition occurred at 100–600° C. (likely in the form of FeO) |
| Fe | 0.7 | 1.9 | Fe prepared from $Fe_2O_3$ via $H_2$ reduction |
| $FeS_2$ | 0.2 | 0.3 | Partially decomposed to FeS at <600° C. |
| FeS | 0.1 | 0.2 | Stable sample |

The results show that sulfides have the lowest coking rates while the oxides show substantially higher coking rates under the same testing condition. The maximum coke formations of these compounds occur typically at the beginning of ethane cracking.

EXAMPLE 2

A series of $H_2$ reduction tests were carried out using the TGTU. The same powder samples, placed in the homogeneous temperature zone (7 in FIG. 1), were heated at 15° C./min to 900° C. in the furnace and then held for 30 minutes. A flow of $H_2$ was admitted through the wet route (3 in FIG. 1) at 25 sccm. The weight changes of these samples were monitored and are given in Table 2.

TABLE 2

| Compound | Reduction Temperature (° C.) Relative Weight Change (wt %) | Likely Intermediate and Final Compound |
|---|---|---|
| $Fe_2O_3$ | 290–350, 520–580, 580–680<br>−3.3, −5.5, −23.5 | $Fe_3O_4$, FeO ⇒Fe |
| $Fe_3O_4$ | 350–420, 570–900<br>−0.5, −27.0 | FeO ⇒Fe |
| $FeSO_4$—$7H_2O$ | 80–350, 430–500, 500–900<br>−33.3, −44.7, −35.7 | $FeSO_4$, FeS ⇒Fe |
| Fe | Not determined | ⇒Fe |
| $FeS_2$ | 500–650, 650–900+<br>−24.5, −17.7 (not complete) | FeS ⇒Fe |
| FeS | ~350–900+<br>−20.6 (not complete) | ⇒Fe |

These results show that Fe oxides can be more easily reduced using wet $H_2$ than the sulfides, with generally lower upper temperatures for the oxides than for the sulfides. For the two sulfides tested, the reduction reactions did not appear to have reached completion at a temperature up to 900° C. and with 30 minutes hold time. Additionally, $Fe_3O_4$ was observed to also reach close to 900° C. for a complete reduction. Such a difference could be attributed to possible differences in crystalline structure between the sample $Fe_3O_4$ and the intermediate product $Fe_3O_4$ converted from $Fe_2O_3$.

EXAMPLE 3

For comparison, three experiments were carried out in the TGTU using carbon steel coupons (A387F22) of 0.187"×0.48"×0.96" in size. The coupons with fresh surfaces polished to 600 grit were placed at the 600° C. position in the TGTU furnace which was maintained at 840° C. with a feed gas flowing through the wet route during the experiments. In one of the experiments, one of the coupons was heated in wet $N_2$ to 600° C. (840° C. furnace temperature) and air flowing at 50 sccm was introduced into the furnace to oxidize the coupon surface for 1 hour, which was to simulate a wet decoke in ethylene plant. Afterwards, dimethyl disulfide vapour was carried in by purging $N_2$ at 50 sccm through the wet route for surface sulfiding of the coupon. Then ethane was introduced into the furnace for steam cracking for 1 hour to determine the coking rate. With the other coupon, an $H_2$ reduction step took place after the oxidation for 1 hour and a steam curing step took place after sulfiding for another hour. The results from both experiments are given in Table 3.

TABLE 3

| Step | Weight Change (wt %) | | |
|---|---|---|---|
| | Baseline | Sulfiding Only | Reduction-Sulfiding-Curing |
| Heat-up in wet $N_2$ | 0.021 | 0.020 | 0.021 |
| Oxidation in wet air | 0.028 | 0.029 | 0.026 |
| Reduction in wet $H_2$ | X(*) | X | −0.004 |
| Sulfiding in wet $N_2$(**) | X | 0.036 | 0.033 |
| Steam curing | X | X | 0.033 |
| Coking rateinethane cracking(mg/hr-$cm^2$) | 0.97 | 0.31 | 0.05 |

Note:
(*)step not executed in the run.
(**)S concentration in the gas feed to TGTU furnace is about 0.45 wt %.

The results show that significant reduction (68%) in coking rate can be achieved by sulfiding alone at a high S concentration. However, adding both $H_2$ reduction prior to sulfiding and steam curing after sulfiding can reduce coke formation further up to 95%.

EXAMPLE 4

Ethane steam cracking tests were carried out in the TCQR with A387F11 carbon steel coupons placed in the TLE section, at positions described previously. Ethane was steam cracked in the furnace at 900° C. (wall temperature) with the residence time at about 1 second. The steam to hydrocarbon ratio was maintained at 0.3 (w/w) and the tests lasted for 10 hours. Based on product analyses from a gas chromatograph, ethane conversion was about 65 wt %, throughout the 10 hours experimentation period. A coke inhibitor consisting of 10 wt % DMDS, 70 wt % TBPS, 10 wt % PTMP and 10 wt % DMP was injected at the simulated TLE inlet at various concentration. The results are listed in Table 4. As a comparison, results from two baseline runs are also included.

The results in Table 5 show that by using the passivation procedure ($H_2$ reduction, surface modifier injection and steam curing), the reduction in total coke formed in the simulated TLE section are in the range up to 76.9 wt %. Inhibitors injected at higher concentration are observed to cause more coke formation at lower temperature (such as at 550° C.) section and therefore, the total coke reduction is affected. Otherwise, inhibitors injected at a concentration between 300 to 650 wppm for about 1 hour are found to give the best results in coke reduction.

EXAMPLE 5

Three experiments were carried out in the TCQR using a naphtha feed collected from a NOVA Chemicals' plant at Corunna. This naphtha was fed into TCQR at 0.19 kg/hr with steam feeding at 50 wt % of the naphtha feed. The cracking furnace was maintained at 850° C. with a residence time at about 1 second. Under such a condition, the conversion of naphtha was about 65 wt % based on gas chromatograph analyses. The overall reaction time for each experiment was maintained for 6 hours. For each experiment, four fresh carbon steel coupons (A387F22) were placed in the simulated TLE section at positions as described previously. Once the cracking furnace reached 850° C. under $N_2$ purge, a steam ramping step was carried out to warm up the TLE section to its desired temperature profile. Thereafter, an oxidation step took place with the purging $N_2$ replaced by air for 60 minutes. This step was to create an oxide layer on the coupon surfaces, simulating plant decoke operation. Afterwards, the coupons went through the passivation steps of reduction, inhibitor injection and steam curing as shown in Table 5. For comparison, a baseline run was carried out without these three steps.

The results (Table 5) show that the overall reduction in coke are 29.9 wt % and 17.2 wt % for test-1 and test-2, respectively, which are much less than the coke reduction observed from ethane cracking experiments (Example 4). However, it is also noted that the reductions in coke formation at higher temperatures are much higher than those at lower temperatures. For instance, at 650° C., the coke reduction is about 75 wt %, while the numbers for 550° C. and 450° C. are 69.7 wt % and 54.5 wt %, respectively. At 350° C., there is very little reduction, if any, in coke formation. This phenomenon is likely a reflection of the difference between coke formed at higher temperatures and at lower temperatures. Often condensation coke is believed to form at low temperatures, such as 350° C., and the formation rate of such coke (or tar) is not sensitive to surface properties. However, at higher temperatures, coke is believed to form through catalytic mechanisms and therefore the formation rate is sensitive to surface properties, such as the presence of coke promoting oxides.

What is claimed is:

1. A process for treating an iron alloy comprising not less than 35 weight % Fe, comprising:

(i) reducing the surface of the iron alloy by contacting it with a mixture comprising from 0.001 to 4.9 weight % of $H_2$ and 99.999 to 95.1 weight % of one or more gases selected from the group consisting of steam and inert gases at a temperature of from 200° C. to 900° C. and a pressure from 0.1 to 500 psig for a time from 10 minutes to 10 hours;

(ii) treating the reduced surface of the iron alloy with a composition comprising:

(a) from 5 to 80 weight % of dimethyl disulfide;

(b) from 10 to 70 weight % tetra-butyl poly sulfide;

(c) from 2 to 15 weight % pentaerythritol tetrakis (3-mercaptopropionate);

(d) optionally from 0 to 10 weight % ethyl 2-mercaptopriopionate;

(e) from 0.1 to 10 weight % dimethyl methylphosphonate; and (f) from 0.2 to 5 weight % disulfiram, the sum of components (a) through (f) being adjusted to total 100 weight %, in an amount from 10 to 10,000 ppm in a carrier gas selected from the group consisting of steam, inert gases and hydrocarbon at a temperature from 400° C. to 850° C. for a time from 10 minutes to 10 hours; and (iii) curing the resulting surface in a carrier gas selected from the group consisting of steam, and inert gases or a mixture there of for a time from 0.1 to 50 hours.

2. The process according to claim 1, wherein the iron alloy comprises at least 50 weight % of Fe.

3. The process according to claim 2, wherein the inert gases are selected from the group consisting of argon, nitrogen and helium.

TABLE 4

| Run ID | $H_2$ Reduction (wppm/hr) | Inhibitor Injection (wppm/hr) | Steam Curing (Steam/$N_2$, w/w) | TLE Coke Formed (mg/hr-cm$^2$) 350° C. | 450° C. | 550° C. | 650° C. | Total Coke Reduction (wt %) |
|---|---|---|---|---|---|---|---|---|
| Baseline-1 | | | | 0.03 | 0.01 | 0.03 | 5.99 | 0 |
| Baseline-2 | | | | 0.02 | 0.01 | 0.02 | 5.82 | 0 |
| Test-1 | 1812/1 | 657/1 | 0.49; 1 hr | 0 | 0.01 | 0.07 | 1.38 | 75.5 |
| Test-2 | 1812/1 | 325/1.5 | 0.49; 1 hr | 0 | 0.01 | 0.08 | 1.29 | 76.9 |
| Test-3 | 1812/1 | 3236/1 | 0.49; 1 hr | 0 | 0.02 | 0.98 | 1.50 | 58.1 |
| Test-4 | 1812/1 | 488/0.5 | 0.49; 2 hrs | 0.02 | 0.02 | 0.04 | 2.06 | 64.2 |
| Test-5 | 1812/1 | 423/2.4 | 0.49; 2 hrs | 0.01 | 0.01 | 0.03 | 1.89 | 67.5 |
| Test-6(*) | 1812/1 | 4500/1.5 | 0.49; 2 hrs | 0.01 | 0.02 | 0.41 | 1.84 | 61.8 |

Note:

(*)inhibitor used for this test contained 5 wt % DSFM, 5 wt % DMP, 20 wt % DMDS, 50 wt % TBPS and 10 wt % PTMP.

TABLE 5

| Run ID | $H_2$ Reduction (wppm/hr) | Inhibitor Injection (wppm/hr) | Steam Curing (Steam/$N_2$, w/w) | TLE Coke Formed (mg/hr-cm$^2$) 350° C. | 450° C. | 550° C. | 650° C. | Total Coke Reduction (wt %) |
|---|---|---|---|---|---|---|---|---|
| Baseline-1 | | | | 3.74 | 0.33 | 0.38 | 0.74 | 0 |
| Test-1 | 1812/1 | 657/1 | 0.49; 1 hr | 3.19 | 0.15 | 0.11 | 0.19 | 29.9 |
| Test-2 | 1812/1 | 325/1.5 | 0.49; 1 hr | 3.86 | 0.15 | 0.12 | 0.17 | 17.2 |

4. The process according to claim 3, wherein in step (i) the ratio of hydrogen to said one or more gases selected from the group consisting of steam and inert gases is from 0.01 to 2 weight % of $H_2$ and the balance said one or more gases; the temperature is from 300° C. to 800° C.; and the pressure is from 0.1 psig to 300 psig and the time is from 30 minutes to 5 hours.

5. The process according to claim 4, wherein in step (ii) the hydrocarbon is selected from the group consisting of ethane, propane, butane, naphtha, vacuum gas oil, atmospheric gas oil and crude oil.

6. The process according to claim 5, wherein in step (ii) said composition is present in said carrier gas in an amount from 20 to 5,000 ppm and the step is carried out at a temperature from 300° C. to 850° C. for a time from 30 minutes to 5 hours.

7. The process according to claim 6, wherein the carrier gas comprises steam at a concentration no less than 2 weight % and the balance one or more inert gases, at a temperature between 200 and 900° C., at steam partial pressures from 0.1 to 100 psig, for a period of time from 0.5 to 20 hours.

8. The process according to claim 7, wherein in step (ii) the composition comprises:

(a) from 25 to 50 weight % of dimethyl disulfide;

(b) from 20 to 40 weight % tetra-butyl polysulfide;

(c) from 5 to 10 weight % pentaerythritol tetrakis (3-mercaptopropionate);

(d) from 3 to 8 weight % ethyl 2-mercaptopriopionate;

(e) from 1 to 5 weight % dimethyl methylphosphonate; and (f) from 0.5 to 1.5 weight % disulfiram, the sum of components (a) through (f) being adjusted to total 100 weight %.

9. The process according to claim 8, wherein in step (i) wherein said one or more gases selected from the group consisting of steam and inert gases is steam and the ratio of hydrogen to steam is from 0.1 to 1 weight % of $H_2$ and the balance steam; the temperature is from 300° C. to 700° C.; and the pressure is from 0.1 psig to 100 psig and the time is from 1 to 3 hours.

10. The process according to claim 9, wherein in step (ii) said composition is present in said carrier gas in an amount from 30 to 2,000 ppm and the step is carried out at a temperature from 500° C. to 700° C. for a time from 1 to 3 hours.

11. The process according to claim 10, wherein the curing takes place for a time from 1 to 10 hours.

12. The process according to claim 11, wherein the iron alloy has a Fe content greater than 60 weight %.

* * * * *